US010231481B2

(12) United States Patent
Volgger et al.

(10) Patent No.: US 10,231,481 B2
(45) Date of Patent: Mar. 19, 2019

(54) EFFICIENTLY PRODUCIBLE CIGARETTE PAPER FOR SELF-EXTINGUISHING CIGARETTES

(71) Applicant: DELFORTGROUP AG, Traun (AT)

(72) Inventors: Dietmar Volgger, Schwaz (AT); Roland Zitturi, Innsbruck (AT)

(73) Assignee: delfortgroup AG, Traun (AT)

( * ) Notice: Subject to any disclaimer, the term of this patent is extended or adjusted under 35 U.S.C. 154(b) by 138 days.

(21) Appl. No.: 14/912,940

(22) PCT Filed: Aug. 7, 2014

(86) PCT No.: PCT/EP2014/067016
§ 371 (c)(1),
(2) Date: Feb. 19, 2016

(87) PCT Pub. No.: WO2015/028276
PCT Pub. Date: Mar. 5, 2015

(65) Prior Publication Data

US 2016/0198761 A1 Jul. 14, 2016

(30) Foreign Application Priority Data

Aug. 29, 2013 (DE) ..... 10 2013 109 386

(51) Int. Cl.
*A24D 1/00* (2006.01)
*A24D 1/02* (2006.01)
(Continued)

(52) U.S. Cl.
CPC ..... *A24D 1/10* (2013.01); *A24D 1/002* (2013.01); *A24D 1/02* (2013.01); *A24D 1/025* (2013.01);
(Continued)

(58) Field of Classification Search
CPC ..... A24D 1/10; A24D 1/002
(Continued)

(56) References Cited

U.S. PATENT DOCUMENTS 9,775,378 B2 * 10/2017 Mohring ..... A24D 1/02
2002/0026948 A1 3/2002 Hampl, Jr. et al. ..... 131/365
(Continued)

FOREIGN PATENT DOCUMENTS

CN 102804064 A 11/2012
DE 10 2012 104 773 A1 12/2013 ..... A24D 1/02
(Continued)

OTHER PUBLICATIONS

Machine Translation of DE 102012104773.*
(Continued)

*Primary Examiner* — Eric Yaary
*Assistant Examiner* — Russell E Sparks
(74) *Attorney, Agent, or Firm* — Sunstein Kann Murphy & Timbers LLP

(57) ABSTRACT

A cigarette paper is disclosed that has at least one treated area to which a composition that contains filler particles or a mixture of filler particles is applied. The diffusion capacity thereby in the at least one treated area is less than in an untreated area of the cigarette paper, wherein at least 20% by weight, preferably at least 50% by weight and particularly preferably at least 70% by weight of the filler particles in the treated area are formed by a filler with a flaked shape or a filler with a cubic shape. Additionally or alternatively, a filler with a scalenohedral or rhombohedral crystal structure can be used, as long as the particle size distribution is selected appropriately.

24 Claims, 5 Drawing Sheets

(51) Int. Cl.

| | |
|---|---|
| ***A24D 1/10*** | (2006.01) |
| ***D21H 17/67*** | (2006.01) |
| ***D21H 21/14*** | (2006.01) |
| ***D21H 21/52*** | (2006.01) |
| ***D21H 17/28*** | (2006.01) |
| ***D21H 19/38*** | (2006.01) |

(52) U.S. Cl.
CPC ..... *D21H 17/28* (2013.01); *D21H 17/67* (2013.01); *D21H 19/38* (2013.01); *D21H 21/14* (2013.01); *D21H 21/52* (2013.01)

(58) Field of Classification Search
USPC ..... 131/365
See application file for complete search history.

(56) References Cited

U.S. PATENT DOCUMENTS

| | | | | |
|---|---|---|---|---|
| 2003/0131860 | A1* | 7/2003 | Ashcraft | A24D 1/025 131/365 |
| 2008/0115794 | A1* | 5/2008 | Oglesby | A24B 15/282 131/58 |
| 2009/0124745 | A1* | 5/2009 | Nover | C01F 11/18 524/425 |
| 2011/0030709 | A1 | 2/2011 | Sebastian et al. | 131/365 |
| 2012/0264865 | A1* | 10/2012 | Shaw | C01F 11/185 524/425 |
| 2015/0090284 | A1 | 4/2015 | Möhring et al. | 131/349 |
| 2015/0289560 | A1 | 10/2015 | Zitturi et al. | A24D 1/025 |
| 2015/0327593 | A1 | 11/2015 | Möhring et al. | A24D 1/02 |

FOREIGN PATENT DOCUMENTS

| | | | |
|---|---|---|---|
| DE | 10 2012 109 642 B3 | 3/2014 | D21H 17/63 |
| DE | 10 2012 111 635 B3 | 3/2014 | D21G 27/00 |
| WO | WO 2009/006570 A2 | 1/2009 | A24D 1/02 |
| WO | WO 2013/178492 A1 | 12/2013 | D21H 27/00 |

OTHER PUBLICATIONS

Calcium Carbonate, Calcite (CaCO3), Tropf, W. J., Handbook of Optical Constraints of Solids III, Academic Press, Published 1998.*

Calcite, Encyclopaedia Britannica, Published 1994, https://www.google.com/search?q=rhombohedron+calcite&rlz=1C1GCEA_enUS795US795&tbs=cdr:1,cd_max:8/28/2013&source=Inms&tbm=isch&sa=X&ved=0ahUKEwil3qP2u9jcAhUBrVkKHW_Ib00Q_AUICigB&biw=1920&bih=1070#imgrc=6NbFvtOIILHfUM:.*

European Patent Office, International Search Report, International Application No. PCT/EP2014/067016 together with the Written Opinion of the International Searching Authority, 10 pages, dated Oct. 10, 2014.

European Patent Office, International Search Report, International Application No. PCT/EP2014/067016, 3 pages, dated Oct. 10, 2014 [English Translation].

Song Baoxiang, "Crystal Morphology of Calcium Carbonate for Papermaking and Its Effect on Paper Quality," *Conference Proceedings of National Conference on Calcium and Magnesium Salts Industry*, pp. 97-105 (2005).

Song Baoxiang, "Crystal Morphology of Calcium Carbonate for Papermaking and Its Effect on Paper Quality," *Conference Proceedings of National Conference on Calcium and Magnesium Salts Industry*, 1 page (2005) (English Summary).

English Translation International Preliminary Report on Patentability, PCT/EP2014/067016, dated Mar. 1, 2016; 10 pages.

Eitzinger, B., et al., "The Effect of Thermal Decomposition of Banded Cigarette Paper on Ignition Strength Test Results," *CORESTA Congress: Cooperation Centre for Scientific Research Relative to Tobacco*, Shanghai, Abstr. SSPT23, 9 pages, 2008.

* cited by examiner

| Example | Filler | | | | Flow time | Diffusion Capacity (230 °C, 30 min) | Ratio |
|---|---|---|---|---|---|---|---|
| No. | Modification | Shape Crystal Structure | $d_{50}$ in µm | $d_{50}/(d_{90}-d_{10})$ | s | cm/s | Paper : Band |
| 1 | Calcite | Flaked | 1.79 | 0.746 | 14.3 | 0.721 | 3.01 |
| 2 | Calcite | Rhombohedral | 1.39 | 0.632 | 15.2 | 0.710 | 3.06 |
| 3 | Calcite | Scalenohedral | 1.87 | 0.994 | 16.5 | 0.572 | 3.80 |
| 4 | Calcite | Scalenohedral | 0.84 | 0.170 | 15.5 | 0.482 | 4.50 |
| 5 | Calcite | Rhombohedral | 1.87 | 0.246 | 15.6 | 0.423 | 5.13 |
| 6 | Calcite | Scalenohedral | 2.01 | 0.708 | 15.0 | 0.418 | 5.19 |
| 7 | Calcite | Rhombohedral | 1.10 | 0.389 | 15.9 | 0.411 | 5.29 |
| 8 | Chalk, geologically sourced | | 2.38 | 0.335 | 15.0 | 0.396 | 5.48 |
| 9 | Calcite | Scalenohedral | 0.97 | 0.659 | 14.5 | 0.393 | 5.53 |
| 10 | Calcite | Scalenohedral | 3.92 | 0.452 | 14.7 | 0.351 | 6.18 |
| 11 | Calcite | Scalenohedral | 4.17 | 0.575 | 15.6 | 0.348 | 6.24 |
| 12 | Calcite, Aragonite | Scalenohedral | 2.06 | 0.472 | 15.6 | 0.323 | 6.72 |
| 13 | Calcite | Cubic | 1.58 | 0.444 | 15.7 | 0.293 | 7.41 |

Fig. 4

| Example No. | Composition as in Example No. | Diffusion Capacity (230 °C, 30 min) cm/s | Ratio Paper : Band |
|---|---|---|---|
| 14 | 2 | 0.804 | 2.70 |
| 15 | 1 | 0.764 | 2.84 |
| 16 | 3 | 0.625 | 3.47 |
| 17 | 6 | 0.459 | 4.73 |
| 18 | 4 | 0.456 | 4.76 |
| 19 | 5 | 0.440 | 4.93 |
| 20 | 7 | 0.440 | 4.94 |
| 21 | 10 | 0.428 | 5.07 |
| 22 | 9 | 0.412 | 5.27 |
| 23 | 8 | 0.400 | 5.43 |
| 24 | 11 | 0.372 | 5.84 |
| 25 | 13 | 0.349 | 6.22 |
| 26 | 12 | 0.320 | 6.77 |

Fig. 5

EFFICIENTLY PRODUCIBLE CIGARETTE PAPER FOR SELF-EXTINGUISHING CIGARETTES

CROSS-REFERENCE TO RELATED APPLICATIONS

This Application is a U.S. national stage entry under 35 USC § 371 of PCT/EP2014/067016 filed Aug. 7, 2014, which itself claims priority to DE 10 2013 109 386.8 filed Aug. 29, 2013.

FIELD OF THE INVENTION

The present invention relates to a cigarette paper that provides a cigarette manufactured therefrom with self-extinguishing properties to, wherein the required paper properties can be adjusted with little effort. In particular it relates to a cigarette paper that is treated in areas with a composition that reduces the diffusion capacity of the cigarette paper and contains a filler material with special crystal structure, particle shape or particle size, and to a process for the production of this paper, and to a cigarette manufactured from this paper.

BACKGROUND AND PRIOR ART

It is a goal of the tobacco industry to produce cigarettes that have a reduced tendency to start fires. Such cigarettes are already subject to legal regulations in various countries and regions, for example the USA, Canada, European Union or Australia. In order to determine whether a cigarette has a reduced tendency to start fires, a test described in ISO 12863:2010 or ASTM E2187 is used.

In the tests, a smoldering cigarette is placed on a defined substrate, for example 10 layers of Whatman™ No. 2 filter paper, and it is observed whether the cigarette self-extinguishes before the entire visible tobacco rod has smoldered away. In many cases the legal regulations demand that of 40 tested cigarettes, at least 30 have to self-extinguish.

One way of accomplishing self-extinguishing of a cigarette in this test consists in applying a composition that reduces the diffusion capacity of the cigarette paper onto areas of the cigarette paper. The functionality of these areas relies on the fact that they prevent the access of oxygen to the glowing cone of the cigarette and thereby lead to self-extinguishing of the cigarette. As the access of oxygen during smoldering is primarily determined by the difference in concentration between the interior of the cigarette and the surroundings, hence by diffusion, it is important to select the diffusion capacity of these areas to be sufficiently low.

The measurement of the diffusion capacity of such areas can be carried out with an appropriate measuring device, such as the Diffusivity Tester (Borgwaldt A50) manufactured by Borgwaldt KC GmbH of Hamburg, Germany, in accordance with CORESTA Recommended Method No. 77. The diffusion capacity thereof describes a gas transport through the cigarette paper driven by a concentration difference. It thus indicates the gas volume passing through the paper per unit time, per unit area and per concentration difference, and hence has the unit $cm^3/(cm^2\ s)=cm/s$.

The diffusion capacity of the areas applied to the cigarette paper required for self-extinguishing of the cigarette depends not only on the properties of the cigarette, but also to a substantial extent on the tobacco blend in the cigarette and the geometry of the cigarette. It is known, for example, that a high proportion of coarse tobacco particles in the tobacco blend, so called stems, makes self-extinguishing less likely, while a high proportion of cut lamina or expanded tobacco is beneficial to self-extinguishing. It is also known that in general, cigarettes with smaller diameter self-extinguish more easily and a longer length for the tobacco rod is also beneficial for self-extinguishing for the simple reason that, for a given design of the areas, more areas treated with the composition are located on the tobacco rod of the cigarette than on a short tobacco rod.

The treated areas of the cigarette paper could simply be provided with a very low diffusion capacity and thereby achieve self-extinguishing substantially independently of the tobacco blend or the overall cigarette construction. This method, however, has the disadvantage that not only the diffusion of oxygen into the cigarette, but also the diffusion of carbon monoxide out of the cigarette, generated during smoldering and puffing in the tobacco rod, is prevented by the areas. Thus, the areas cause an increase in the carbon monoxide content in the smoke that is undesirable because of the usual legal provisions related to the maximum carbon monoxide content in the smoke. In addition, too low a diffusion capacity leads to frequent self-extinguishing of the cigarette during normal smoking, which reduces the smoker's acceptance of such cigarettes.

In the prior art it is known to provide the areas as bands in cross-direction of the cigarette paper so that they are located in circumferential direction on a cigarette manufactured from this paper. It is also known that a minimum width of the bands of 4 mm is required in many cases in order to obtain self-extinguishing at all. In practice, however, it frequently turns out that in order to comply with legal requirements, 6 mm wide bands, printed over their entire area, are typically necessary on the cigarette paper. The distance between the bands, however, typically results from the length of the tobacco rod of the cigarette, since a frequent legal requirement is that at least two bands have to be present on the tobacco rod. Other shapes for the areas, for example, 6 or 7 mm wide bands, divided by a 1 mm wide slit are also known. In principle, the areas can have any arbitrary shape as long as it is compatible with the process for applying the composition and a sufficient self-extinguishing rate can be ensured.

From the prior art, many compositions are known that can be applied in areas on the paper. Frequently, these are aqueous compositions that comprise at least one film-forming material. This film-forming material forms a superficial film during drying of the paper after application and thereby seals the pores of the paper and hence reduces the diffusion capacity. Other materials that enter into the pores instead are also known. In some cases, the composition also contains pigments. These pigments can provide a color to the areas, but in many cases they are white in order to equalize the opacity and the whiteness of the treated areas and the untreated paper and therefore make them barely visible.

Application of the composition to the paper can be carried out by any possible application method in the prior art; printing processes or spraying have proved to be of value. Application can be carried out after the production of the untreated paper or during paper production in the paper machine.

The manufacturer of cigarette papers for self-extinguishing cigarettes is thus required to provide a paper the diffusion capacity of which is adapted to the entire cigarette construction such that the legal requirements are complied with, but that the diffusion capacity is not unnecessarily low. Hence the cigarette paper manufacturer has to be able to adjust the diffusion capacity of these areas with the most efficient means possible over the largest range possible, so that even smaller quantities of such papers can be produced cost-effectively. While a cigarette paper grade can in principle be used for many different cigarette constructions and thereby large production batches can be produced when there is no requirement for self-extinguishing, this requirement increases the number of different paper grades and consequently the size of a production batch decreases.

The prior art allows for several options to adjust the diffusion capacity of the treated areas of the cigarette paper.

One option consists in adjusting the geometry of the treated areas. The smaller the treated area, the less likely the self-extinguishing may be. A change of the geometry of the treated areas, however, is not particularly efficient, because it requires changing the printing cylinder, for example for printing processes such as roto-gravure printing, which takes some time and reduces productivity. In addition, for each geometry under consideration, one printing cylinder and potentially a reserve cylinder have to be procured and stored. Thus, this process is relatively expensive for small production batches.

A further option consists in varying the amount of composition applied to the cigarette paper per unit area of the treated areas. This can also be carried out for a printing process, for example, roto-gravure printing, by means of the printing cylinder. The printing cylinder has a plurality of small engraved or etched recesses corresponding to the printing pattern, into which the composition is picked up from a storage tank and is transferred from the recesses onto the paper. The applied amount can be influenced by the volume or other properties of the recesses. The disadvantages in relation to changing the printing cylinder and storing the printing cylinders are, however, the same as when adjusting the geometry of the areas.

Finally a further option consists in varying the proportion of the film-forming material in the composition. The less film-forming material is in the composition, the less film-forming material is transferred to the paper for the same applied amount of the composition. This method has the disadvantage that the viscosity of this composition also changes when the proportion of the film-forming material in the composition is changed. Most application processes do not permit large variations in the viscosity of the composition to be applied or require corresponding adjustments to the process parameters, such as velocities or drying temperatures, for which reason this method can be used only within tight limits. The viscosity can, however, also be adjusted by the selection of the film-forming material, but this is very tightly limited by the legal requirements regarding the components of cigarette paper as well as the influence on the taste of a cigarette manufactured from such a paper.

There is a need for an option for adjusting the diffusion capacity of the treated areas of the cigarette paper simply and inexpensively, so that comparatively small batches of cigarette paper can be produced efficiently each with a different diffusion capacity in the treated areas of the paper.

SUMMARY OF THE INVENTION

The object of the present invention is to provide a cigarette paper that has a defined diffusion capacity in treated areas and can be produced inexpensively.

This object is achieved by means of a cigarette paper according to claim 1 and a process according to claims 17 and 27. Such a cigarette paper can be used in a cigarette according to claim 33. Advantageous further embodiments are disclosed in the dependent claims.

The cigarette paper according to the invention has treated areas, onto which a composition is applied that contains filler particles or a mixture of filler particles, wherein the diffusion capacity in the treated areas is less than in an untreated area of the cigarette paper. In this regard, at least 20% by weight, preferably at least 50% by weight and particularly preferably at least 70% by weight of the filler particles in the applied composition are formed by one or more of the following filler particle types:

(a) calcium carbonate with a flaked shape, (b) a filler with a scalenohedral crystal structure and with a particle size distribution for which the following holds:

$p \geq 0.7$, preferably $p \geq 0.8$, particularly preferably $p \geq 0.85$, and in particular $p \geq 0.9$, or $p \leq 0.3$, preferably $p \leq 0.25$, and particularly preferably $p \leq 0.2$, (c) a filler with a rhombohedral crystal structure and with a particle size distribution for which the following holds:

$p \geq 0.5$, preferably $p \geq 0.6$ and particularly preferably $p \geq 0.7$, (d) a filler with a cubic shape or (e) a filler with a scalenohedral crystal structure and with a particle size distribution for which the following holds:

$p \geq 0.40$, preferably $p \geq 0.45$ and $p \leq 0.60$, preferably $p \leq 0.55$.

In this regard, p is a dimensionless parameter that is defined by $d_{50}/(d_{90}-d_{10})$ and represents a median particle size $d_{50}$ with respect to the distribution width $d_{90}-d_{10}$ All indications related to particle sizes in this regard refer to the particle size distribution determined in accordance with ISO 13320:2009 by means of laser diffraction and a model according to Mie. From the particle size distribution determined in this manner, it can be seen which volumetric fraction of the particles is smaller than a defined size. In the present disclosure, such fractions are given in the form "$d_x$", wherein x is a number between 0 and 100 and d is a measure of the particle size. As an example, $d_{10}$=0.5 μm indicates that 10% by volume of the particles are smaller than 0.5 μm. The particle size "d" corresponds to the diameter of a spherical particle. For particles that are not spherical in shape, it corresponds to the diameter of a spherical particle that, measured in accordance with ISO 13320:2009, leads to the same results as the particle that is not spherical in shape.

According to the invention, the object is hence achieved by applying a composition that contains filler particles or a mixture of filler particles to areas on the cigarette paper, whereby a desired diffusion capacity of the areas can be obtained by means of the crystal structure, shape or size distribution of these filler particles.

The starting point for the following considerations and explanations is the diffusion capacity of the areas of a cigarette paper that is treated in these areas with a composition that contains geologically sourced chalk with a median particle size of about 2.38 μm. Such geologically sourced chalk is an obvious choice and will be considered to be the "normal filler" in the following description of the invention. Terms like "high", "higher", "low", "lower" or "median" in relation to the diffusion capacity should be understood to be with respect to this point of reference.

The present invention is based on the finding that the diffusion capacity in the treated areas can change as a function of the properties of shape, crystal structure and particle size distribution of the filler—at otherwise the same composition and the same filler content by weight—, and this to an extent that permits the diffusion capacity of a plurality of base papers and cigarette configurations to be adjusted such that an appropriate diffusion capacity results. The "appropriate diffusion capacity" in this regard is, for example, a diffusion capacity that leads to reliable self-extinguishing in a test in accordance with ISO 12863:2010 or ASTM E2187, but at the same time prevents the cigarette from self-extinguishing during the normal smoking process.

Adjusting the diffusion capacity by selecting the filler according to one or more of the three aforementioned criteria is of particular technical relevance, because the further properties of the composition that have an influence on the manufacturing process do not change, or at least do not change substantially. This would be different if the diffusion capacity were to be adjusted, for example by the proportion by weight of the filler, because in that case the macroscopic physical properties of the composition, in particular the viscosity, would be changed so that the entire manufacturing process is influenced.

To be able to purposefully adjust the diffusion capacity in the treated areas, it is important to identify such filler types that can increase or reduce the diffusion capacity compared with a composition with a "normal filler", for example geologically sourced chalk.

The filler types (a)-(c) mentioned above initially lead to an increase in the diffusion capacity, while the filler types (d) and (e) lead to a reduction in the diffusion capacity compared with a composition with a common, geologically sourced chalk and thus they are well suited to adjusting the diffusion capacity of the treated areas to the desired value.

More precisely, the inventors have found that the diffusion capacity of the cigarette paper can be increased—with conditions otherwise unchanged—if at least a part of the filler particles have a flaked shape (compare feature (a)).

The inventors have also found that the diffusion capacity of the areas of the cigarette paper can be reduced, under otherwise unchanged conditions, if at least a part of the filler particles in the composition has a cubic shape (feature (d)).

Finally, the inventors have found that the diffusion capacity of the treated areas of the cigarette paper is in a median range, under otherwise unchanged conditions, if at least a part of the filler particles in the composition has a scalenohedral or rhombohedral crystal structure. In relation to scalenohedral and rhombohedral crystal structures the inventors have, however, found that the diffusion capacity can be adjusted as a function of a simple parameter, namely the particle size distribution. In this regard, fillers with rhombohedral and scalenohedral crystal structures also have the potential to increase (features (b) and (c)) or—in the case of a scalenohedral crystal structure—to decrease (feature (e)) the diffusion capacity, compared with that which results from the (otherwise the same) composition with geologically sourced chalk as the filler.

Thus, for fillers with a scalenohedral crystal structure, the diffusion capacity can be adjusted by means of a dimensionless parameter p derived from the particle size distribution. It turns out that the median particle size $d_{50}$ with respect to the distribution width $d_{90}-d_{10}$ that is the parameter $p=d_{50}/(d_{90}-d_{10})$, is particularly well suited in this regard. A very good linear correlation with a correlation coefficient of greater than 0.94 has been found between the diffusion capacity and the parameter $p\times(p-1)$. This means that with a scalenohedral filler, for a low diffusion capacity the parameter p is selected to be at least 0.4, preferably at least 0.45 and at most 0.6, preferably at most 0.55. To achieve a high diffusion capacity, the parameter p will be either selected so as to be low, that is at least 0 and at most 0.3, preferably at most 0.25, and particularly preferably at most 0.2, or will be selected so as to be high, that is at least 0.7, preferably at least 0.8 and particularly preferably at least 0.85 and in particular at least 0.9.

With fillers with rhombohedral crystal structures, the diffusion capacity can also be adjusted by means of the same dimensionless parameter $p=d_{50}/(d_{90}-d_{10})$ derived from the particle size distribution. A very good linear correlation with a correlation coefficient of more than 0.98 has been found between the diffusion capacity and the parameter $p\times(p-0.6)$. This means that with a rhombohedral filler, for a comparatively low diffusion capacity the parameter p should be selected to be at least 0.1, preferably at least 0.2 and at most 0.5, preferably at most 0.4. To achieve a high diffusion capacity, the parameter p will be selected so as to be high, that is at least 0.5, preferably at least 0.6 and particularly preferably at least 0.7. Whether a particularly low choice of the parameter p leads to an increase of the diffusion capacity cannot be concluded from the available data, but the skilled person will be able to determine this easily if suitable fillers are available.

Independently of whether the shape of the filler particles is flaked, or cubic or the crystal structure is scalenohedral or rhombohedral, the proportion of these filler particles in the total amount of filler particles in the composition should be at least 20% by weight, preferably at least 50% by weight and particularly preferably at least 70% by weight.

The higher the proportion of these filler particles, the stronger will become the effect on the diffusion capacity related to their shape.

According to the invention, the particles should, independently of their shape, have a median size $d_{50}$ of at least 0.1 μm, preferably at least 0.3 μm, and particularly preferably at least 0.5 μm. The median size $d_{50}$ should be at most 10 μm, preferably at most 7 μm and particularly preferably at most 5 μm.

In particular for flaked or cubic filler particles, a median size $d_{50}$ of at least 0.5 μm, preferably at least 1.0 μm and at most 5 μm and preferably at most 3 μm has been proved to be of value.

For flaked calcium carbonate particles, a range for the distribution parameter $p=d_{50}/(d_{90}-d_{10})$ from at least 0.5, preferably at least 0.6 to at most 1.0, preferably at most 0.9 is well suited.

For cubic filler particles, a range for the distribution parameter $p=d_{50}/(d_{90}-d_{10})$ from at least 0.2, preferably at least 0.3 to at most 0.7, preferably at most 0.6 is well suited.

In a preferred embodiment, the flaked calcium carbonate particles have a length l, a width b and a thickness d, which each correspond to the maximum dimension in three mutually orthogonal spatial directions, wherein both the length l and the width b are at least twice as large, preferably at least four times as large as the thickness d.

The length l and the width b are typically different from each other, but they should differ by a factor of less than 5, preferably less than 3 and particularly preferably less than 2.

In an idealized conception of a nearly cuboid geometry, the length l, the width b and the thickness d could correspond, for example, to the lengths of the sides of the cuboid, that is, it is not at all necessary for the length l to correspond to the maximum dimension of the particle, which in an idealized cuboid would correspond to the body diagonal. As a rule, the length l will, however be greater than or equal to the width b and will itself differ by a factor of 2.5 or less from the maximum spatial extension of the particle.

As an illustration, reference should be made to FIG. 3, which illustrates a flaked calcium carbonate particle, in which the length l, width b and thickness d are indicated.

Although there are no special restrictions apart from the crystal structure, shape, size and size distribution of the filter particles, they are preferably white, so that the treated areas of the cigarette paper differ optically from the untreated areas of the same cigarette paper by as little as possible.

The filler particles can be metal salts, metal oxides or metal hydroxides, for example, preferably calcium carbonate, titanium dioxide, magnesium dioxide, magnesium hydroxide or aluminium hydroxide. Iron oxides can be used, but they are not preferred, because they are in general not white but often red, brown, yellow or black. For colored cigarette papers, however, they can be advantageously selected.

A preferred filler is calcium carbonate and in this case in particular precipitated calcium carbonate, because it is purer than geologically sourced, and the purity requirements for cigarette paper can be more easily complied with. Among the mineral forms of calcium carbonate such as calcite, aragonite and vaterite, with which the invention can in principle be realized, calcite is preferred because of its easy availability.

The proportion of the filler according to the invention in the composition can vary. In compositions according to the invention that reduce the diffusion capacity of the cigarette paper, the filler should be present in an amount of at least 1% by weight, preferably at least 3% by weight and at most 20% by weight and preferably at most 10% by weight. Since the filler particles in the composition increase the diffusion capacity with increasing fraction irrespectively of their shape, the filler content in the composition is primarily determined by how strongly the other components in the composition can reduce the diffusion capacity. It is possible, but not in accordance with the invention, to vary the diffusion capacity by changing the amount of filler in the composition. This, however, also influences the viscosity of the composition, which may require additional adaptations in the application process, for example, to the velocity or drying temperatures. According to the invention, however, the filler content in the composition should remain constant and the diffusion capacity should be adjusted only by changing the shape, crystal structure or size of the filler particles.

The composition itself firstly comprises a solvent, wherein the term "solvent" should not mean that it is a solution in the more strict chemical sense. In most cases the filler particles will be suspended and not dissolved in the solvent. Water is a particularly preferred solvent, because it is toxicologically unproblematic and does not influence the aroma and taste of the paper. For reasons of taste and to avoid impurities, drinking water is particularly preferred. The use of distilled or de-ionized water is possible, but does not generate any additional advantages. Other solvents such as ethanol or ethyl acetate, although not preferred, have at least the advantage compared with water that they can be evaporated with lower temperatures and lower energy consumption during drying and that they do not cause wrinkles by swelling the fibers in the paper. Mixtures of solvents can also be used.

The composition comprises, in addition to the solvent and the filler, at least one material that is capable of reducing the diffusion capacity when applied to the cigarette paper. Preferably, such a material is film-forming. Film-forming materials that are selected from a group consisting of starch, starch derivatives, cellulose, cellulose derivatives, dextrins, guar or gum Arabic and alginates or mixtures thereof are preferred. Oxidized starches and sodium alginate are particularly preferred.

The proportion of the material that reduces the diffusion capacity in the composition can vary over a wide range and will primarily be determined, by how strongly the material is capable of reducing the diffusion capacity and which viscosity the composition should have for the application process. In general, the material for reducing the diffusion capacity will be contained in the composition in a proportion of at least 0.1% by weight, preferably at least 1% by weight and particularly preferably at least 3% by weight. The material should constitute at most 40% by weight, preferably at most 30% by weight and particularly preferably at most 25% by weight of the composition. Here again, the invention is not concerned with controlling the diffusion capacity by changing the proportion or the type of the material that reduces the diffusion capacity in the composition, but instead the proportion and the material should be unchanged and only the type of filler be varied, so that as far as possible, the viscosity and other process parameters do not change.

Further materials in the composition can be contained in the composition in order to control specific properties of the composition of the paper. This includes materials for adjusting the viscosity, for adjusting the color, or indeed substances such as, for example, citrates, acetates and phosphates or other burn additives that control the smoldering speed of the cigarette paper. The skilled person will be able to determine the content of these materials in the composition according to the technological requirements on the paper or the application process.

For the application in a printing process, in particular roto-gravure or flexographic printing, a composition with a flow time of at least 10 s, preferably at least 12 s and at most 35 s, preferably at most 25 s, measured with a flow cup with an opening of 4 mm in accordance with the standard represented by ONORM EN ISO 2431:2011 at a temperature of the composition of 60° C., has been proved of value.

Preferably, the amount of material applied in the areas of the cigarette paper, given as the mass per unit area in the dried state, is at least 0.5 $g/m^2$, preferably at least 1 $g/m^2$ and/or at most 12 $g/m^2$, preferably at most 8 $g/m^2$. With such applied amounts, the desired diffusion capacity can be achieved in an advantageous manner.

In order to estimate the diffusion capacity of the cigarette paper on the cigarette during smoking, the cigarette paper can be heated prior to the measurement. In this case, the cigarette paper is stored in a heating cabinet, pre-heated to 230° C., for 30 minutes in an atmosphere of air, and then removed from the oven and conditioned in accordance with ISO 187:1990. The measurement of the diffusion capacity is carried out in accordance with CORESTA Recommended Method No. 77 with a Diffusivity Tester (Borgwaldt A50) manufactured by Borgwaldt KC GmbH of Hamburg, Germany.

Due to the thermal decomposition of the cigarette paper, the diffusion capacity increases as a function of the paper properties and the type of the material that reduces the diffusion capacity in the composition. After this thermal treatment, the diffusion capacity of the treated areas is at least 0.05 cm/s, preferably at least 0.1 cm/s and at most 2 cm/s, preferably at most 1 cm/s. The diffusion capacity can vary from area to area, and also a change of the diffusion capacity within an area is possible, for example to have a positive influence on the carbon monoxide content in the smoke, as long as the self-extinguishing in accordance with ISO 12863:2010 is not jeopardized.

Application of the composition can be carried out using any known prior art processes, in particular by printing or spraying processes. For example, roto-gravure printing or flexographic printing are particularly well suited.

The application is in most cases on the wire side of the cigarette paper, because it faces the tobacco, and the areas are less visible by the smoker during normal use of the cigarette. An application to the upper side is also possible, as this side of the paper is better suited for printing.

Application can be carried out in one or more layers, with or without drying of the paper between the application processes, wherein, because of the required registering, i.e. positioning, of the individual layers with respect to each other, application in as few layers as possible, in particular in only a single layer, is preferred. In the case that more layers are applied, it is not required that all layers are identical with respect to their shape and the applied amount and even with respect to the composition. Here there is a lot of scope for fine-tuning the paper properties, in particular the diffusion capacity, that is already known in the prior art to some extent, but is accessible to the skilled person by simple experimentation. The principle of the present invention, however, remains applicable.

Application of an aqueous composition can involve the formation of wrinkles on the paper that can be removed by a further treatment, for example, humidification of the paper with subsequent drying under mechanical loads. In addition, substances to reduce the formation of wrinkles, such as propylene glycol or glycerin, can be contained in the composition.

The invention can be combined with many further treatment steps of the cigarette without problems, as the skilled person will easily be able to determine experimentally. This includes, for example, embossing, the printing of patterns to improve the optical appearance, or coating with substances to influence the composition of the smoke of a cigarette manufactured from this paper, in particular the substances in the smoke known as "Hoffmann analytes". These steps can be carried out according to the requirements before or after the application of the composition to the paper.

The processability of the cigarette paper in accordance with the invention on commercially available cigarette machines is unchanged.

There are no special requirements for the cigarette paper. Basically, any prior art cigarette paper can be used in the context of the invention. This includes cigarette papers for machine-made as well as for hand-made or partially hand-made cigarettes.

The cigarette paper preferably has a basis weight from 9 $g/m^2$ to 70 $g/m^2$, preferably between 20 $g/m^2$ and 50 $g/m^2$ and preferably it consists of pulp fibers, for example, wood pulp fibers or pulp fibers from annual plants, such as hemp, flax or esparto grass. The cigarette paper preferably also contains filler materials, typically in a range from 0% by weight to 50% by weight, preferably 10% by weight to 45% by weight of the paper mass, for example chalk, kaolin, titanium dioxide, aluminium hydroxide, magnesium oxide, magnesium hydroxide or, more rarely, iron oxides. Precipitated chalk is preferred. Additionally, the cigarette paper can contain salts, for example, to control the smoldering speed or other paper properties, including, for example, citrates, acetates or phosphates, malates, tartrates, nitrates, succinates, fumarates, gluconates, glycolates, lactates, oxylates, salicylates, α-hydroxycaprylates, hydrogen carbonates, carbonates, such as tri-sodium citrate, tri-potassium citrate or mono-ammonium phosphate. They are preferably contained in the paper mass in an amount in the range from 0% by weight to 7% by weight and are typically applied to the paper from an aqueous solution in the size or film press of a paper machine or a separate apparatus. Other substances, for example colorants, can be added to the cigarette paper as long as they are legally permitted and toxicologically harmless.

In a preferred embodiment, the process for the production of the cigarette paper comprises the following steps:

- producing a first amount of a preliminary composition that contains a solvent and a material that is capable of reducing the diffusion capacity of the cigarette paper,
- removing a first part of the preliminary composition,
- adding a filler containing at least one or more of the above mentioned types of filler (a)-(e) to the removed first part of the preliminary composition in order to form a first composition, and
- treating areas of the base cigarette paper with the first composition.

Thus, in this embodiment the composition is not formed as a whole in a single process, that is, including the filler. Instead, firstly just a preliminary composition is produced that in fact contains a solvent and a material that is capable of reducing the diffusion capacity of the cigarette paper, but not yet the filler, at least not yet in the final amount. From this preliminary composition a part is removed, to which filler or a mixture of fillers is added, to form a first composition, while a (as the case may be, large) part of the preliminary composition is at first held back. With this first composition, a comparatively small amount of base cigarette paper can be treated and it can be checked as to whether the diffusion capacity in the treated areas is reduced to the desired extent. In this manner, the preliminary composition can be produced in larger amounts and thus economically, while initially only a part of it is completed to form a first composition. If it turns out that the first composition results in the desired reduction of the diffusion capacity in the treated areas, a further part or the entire remainder of the preliminary composition can also be completed by the same selection of filler or fillers.

If the diffusion capacity in the treated areas does not lead to the desired diffusion capacity, the process can be continued as follows:

- removing a second part of the preliminary composition,
- adding fillers containing at least one of the aforementioned filler types (a)-(e) to the removed second part of the preliminary composition in order to form a second composition, wherein the selection of the added filler particles differs in type or proportions from that of the first composition, and
- treating areas of a base cigarette paper with the second composition.

In this manner, determination of the filler or a suitable mixture of filler types respectively that leads to the desired diffusion capacity in the treated areas can be carried out in a simple and economic manner. This will be further explained below with the aid of several examples.

In an advantageous embodiment, the addition of fillers to the respective removed part of the preliminary composition is carried out in the application apparatus or in a feeding pipe to the application apparatus for application of the first or second composition, respectively. In this case, addition of filler can be varied "on-line" during the application process, so that a suitable filler or suitable mixture of fillers, respectively, can be determined in a simple way and with comparatively little waste. It should be understood that continuously feeding a preliminary composition for the addition of filler can constitute "removing" a part of the preliminary composition, because fillers are always added only to a part of the preliminary composition and there is the possibility that different fillers can be added to different parts of the preliminary composition.

In an advantageous embodiment, the process for producing the cigarette paper comprises the following steps:

A providing a base paper,

B treating selected areas of the base paper with a composition for reducing the diffusion capacity of the base paper in the treated areas, wherein the composition contains at least a first filler, C measuring the diffusion capacity in a treated area at least approximately, D determining whether the diffusion capacity differs from a target value, E in the case in which the difference between the measured diffusion capacity and the target value exceeds a predetermined threshold value, providing a modified composition which differs from the composition of step B at least in that at least a part of the first filler is replaced by a second filler that differs from the first filler in one of the features of shape, crystal structure and particle size distribution, to reduce the deviation of the diffusion capacity from the target value.

Preferably, the steps B-E are repeated until the deviation between the measured diffusion capacity and the target value falls below a threshold value. If this process is carried out automatically, it can be carried out by means of a controller. However, this process can also be carried out "manually" or semi-automatically, for example, whereby in step E a person decides, based on the deviation of the measured diffusion capacity from the target value, which filler should be taken as "second filler", to replace a part of the "first filler".

Preferably, the at least approximate measurement of the diffusion capacity is carried out by measuring the transmission, absorption and/or reflection of electro-magnetic radiation. In this way, however, the diffusion capacity cannot be determined as precisely as by the method described initially, but it has the advantage that the diffusion capacity can be determined "on-line", that is, during the treatment process.

In the case in which the diffusion capacity measured in step D is below the target value, it is clear that the second filler is at least partially formed by one or more of the aforementioned filler particle types (a)-(c). If the diffusion capacity measured in step D is above the target value, the second filler can be formed at least partially by one or both of the aforementioned filler particle types (d) and (e). The process, however, is not limited to this. Instead, it can also employ other filler particle types that have the desired influence on the diffusion capacity.

In an advantageous embodiment, the composition contains two filler types that differ with respect to one the features of shape, crystal structure and particle size distribution and of which one filler—at the same ratio by weight and otherwise the same composition—leads to a higher diffusion capacity in the treated area than the other filler. In this case, the proportion of the two fillers in the composition is modified in step E compared with the composition of step B, to reduce the deviation of the diffusion capacity from the target value. Such a process is comparatively simple, but nevertheless allows for a comparatively large variation in the achievable diffusion capacity for a suitable selection of the two filler types.

BRIEF DESCRIPTION OF THE FIGURES

FIG. 4 shows a table with diffusion capacities and viscosity values for various filler types when using a first base paper A.

FIG. 5 shows a table with diffusion capacities for various filler types when using a second base paper B.

EXAMPLES

Figure 1:
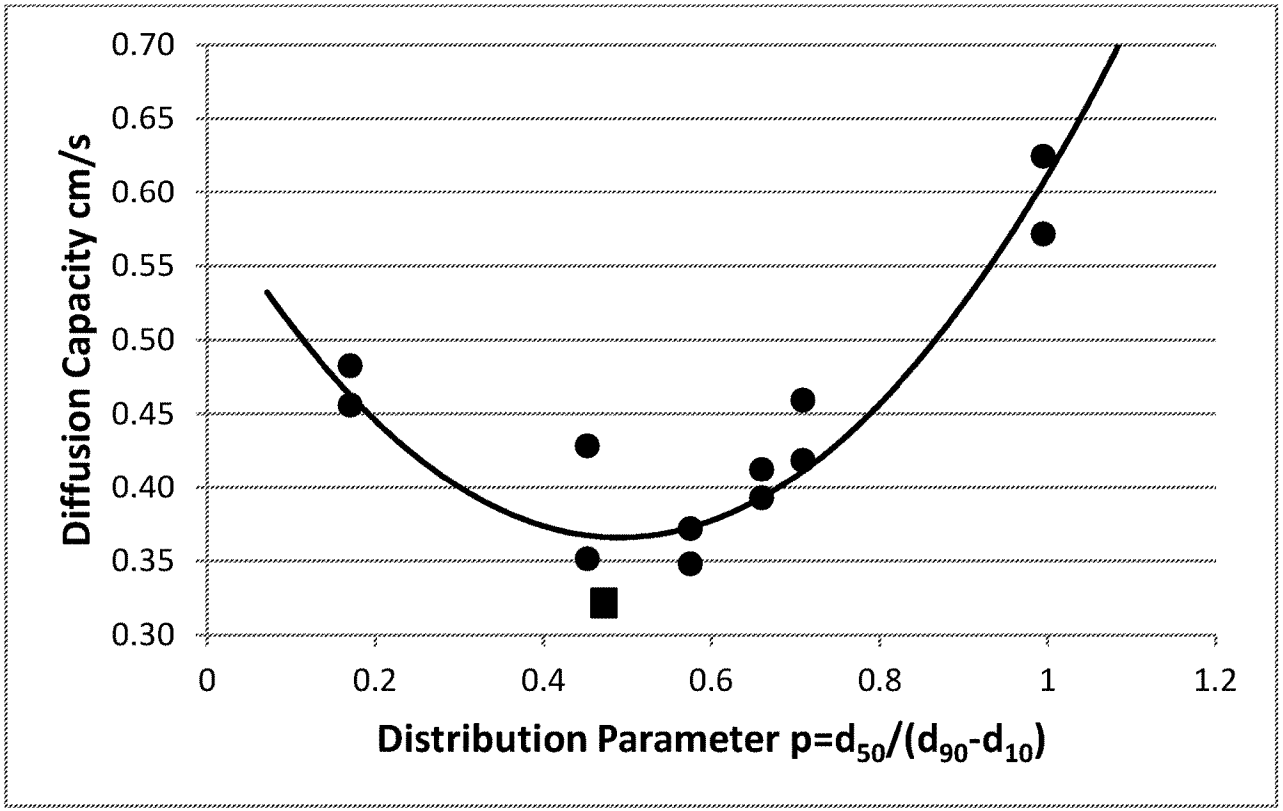
FIG. 1 shows, for scalenohedral fillers, the relationship between the dimensionless distribution parameter p of the particle size distribution and the diffusion capacity.

For a better understanding of the present invention it is illustrated below in some examples.

The composition applied to the paper is an aqueous composition consisting of 13% by weight oxidized starch, 0.5% by weight cationic starch and 6% by weight chalk as filler. The composition was produced according to the manufacturer's instructions. In total, 13 different fillers were selected in accordance with FIG. 4 and one of the fillers was each dispersed in the composition.

The flow time of the composition as a measure of the viscosity was determined with a flow cup with an opening of 4 mm in accordance with the standard represented by ONORM EN ISO 2431:2011 at a temperature of the composition of 60° C. and is shown in FIG. 4.

The composition was applied to two different cigarette papers A and B. Before application of the composition, cigarette paper A had a basis weight of 25 $g/m^2$, an air permeability in accordance with ISO 2965 of 70 $cm \cdot min^{-1} \cdot kPa^{-1}$, a filler content of 33% by weight and a content of 1% by weight tri-potassium citrate as burn additive, while cigarette paper B had a basis weight of 24 $g/m^2$, an air permeability in accordance with ISO 2965 of 75 $cm \cdot min^{-1} \cdot kPa^{-1}$, a filler content of 29% by weight and a content of 2% by weight tri-potassium citrate as burn additive. To simulate the thermal decomposition of the cigarette paper during smoking, the cigarette paper was stored in a heating cabinet, pre-heated to 230° C., for 30 minutes in an atmosphere of air, and then it was removed from the heating cabinet and conditioned in accordance with ISO 187:1990. The measurement of diffusion capacity was then carried out in accordance with CORESTA Recommended Method No. 77 with a Diffusivity Tester (Borgwaldt A50) manufactured by Borgwaldt KC GmbH of Hamburg, Germany.

Without application of the composition, after the above heating process, both cigarette papers had an average diffusion capacity of 2.17 cm/s calculated from 10 individual values.

The application of the composition was carried out by means of a roto-gravure printing station in accordance with the prior art in one layer on the wire side of the original, that is not heat-treated, cigarette paper, in the shape of 6 mm wide bands oriented in the cross-direction of the paper with a distance from band centre to band centre of 27 mm. After application, the paper was dried.

In similar manner to that described above for the measurement of the diffusion capacity of the cigarette paper without application of the composition, the paper, now with the composition applied to it, was stored in a heating cabinet, pre-heated to 230° C., for 30 minutes in an atmosphere of air, then it was removed from the heating cabinet and conditioned in accordance with ISO 187:1990. The measurement of diffusion capacity was then carried out in accordance with CORESTA Recommended Method No. 77 with a Diffusivity Tester (Borgwaldt A50) manufactured by Borgwaldt KC GmbH of Hamburg, Germany, each on 10 different positions. The mean values of the diffusion capacities are shown in tables 1 and 2 of FIGS. 4 and 5.

The ratio of the mean values of the diffusion capacities of the untreated cigarette paper and the treated areas is given in table 1 of FIG. 4 for paper A and in table 2 of FIG. 5 for paper B, each in the column "Ratio".

The geologically sourced and ground chalk of examples 8 and 23 serves as a point of reference.

It can be seen firstly from examples 1 and 15 that an extraordinarily high diffusion capacity can be achieved with flaked calcite. The use of such types of filler causes a decrease of the diffusion capacity by a factor between 2 and 4 compared with that of the untreated cigarette paper. On the contrary, with a cubic calcite, examples 13 and 25, a very low diffusion capacity and correspondingly a decrease of the diffusion capacity compared with that of the untreated cigarette paper by a factor 5 to 8 is obtained.

The scalenohedral and rhombohedral calcites of the remaining examples provide mostly diffusion capacities in the median range.

In FIG. 1 the values of the distribution parameter p and the diffusion capacities for papers, to which a composition with a scalenohedral filler has been applied, are shown graphically, that is, for examples 3, 4, 6, 9-11, 16-18, 21, 22 and 24 as a round dot, and for examples 12 and 26, for which the filler also contains aragonite in addition to calcite, as a small square. It can clearly be seen that for low values of p, for example, $p<0.3$, as well as for high values of p, for example, $p>0.7$, a high diffusion capacity can be obtained. In these ranges for the parameter p, the diffusion capacity is reduced by factor 3 to 6 compared with the untreated cigarette paper. For values of p between 0.3 and 0.7, low diffusion capacities and correspondingly a decrease of the diffusion capacity by a factor greater than 6 are obtained. The line in FIG. 1 shows the curve $p\times(p-1)+0.6$ cm/s and illustrates the good correlation of this parameter with the diffusion capacity. The correlation coefficient is greater than 0.94.

Examples 12 and 26 show a mixture of calcite and aragonite, with primarily scalenohedral crystal structure. The data are shown as a small square in FIG. 1 and fit well into the picture for scalenohedral fillers.

Figure 2:
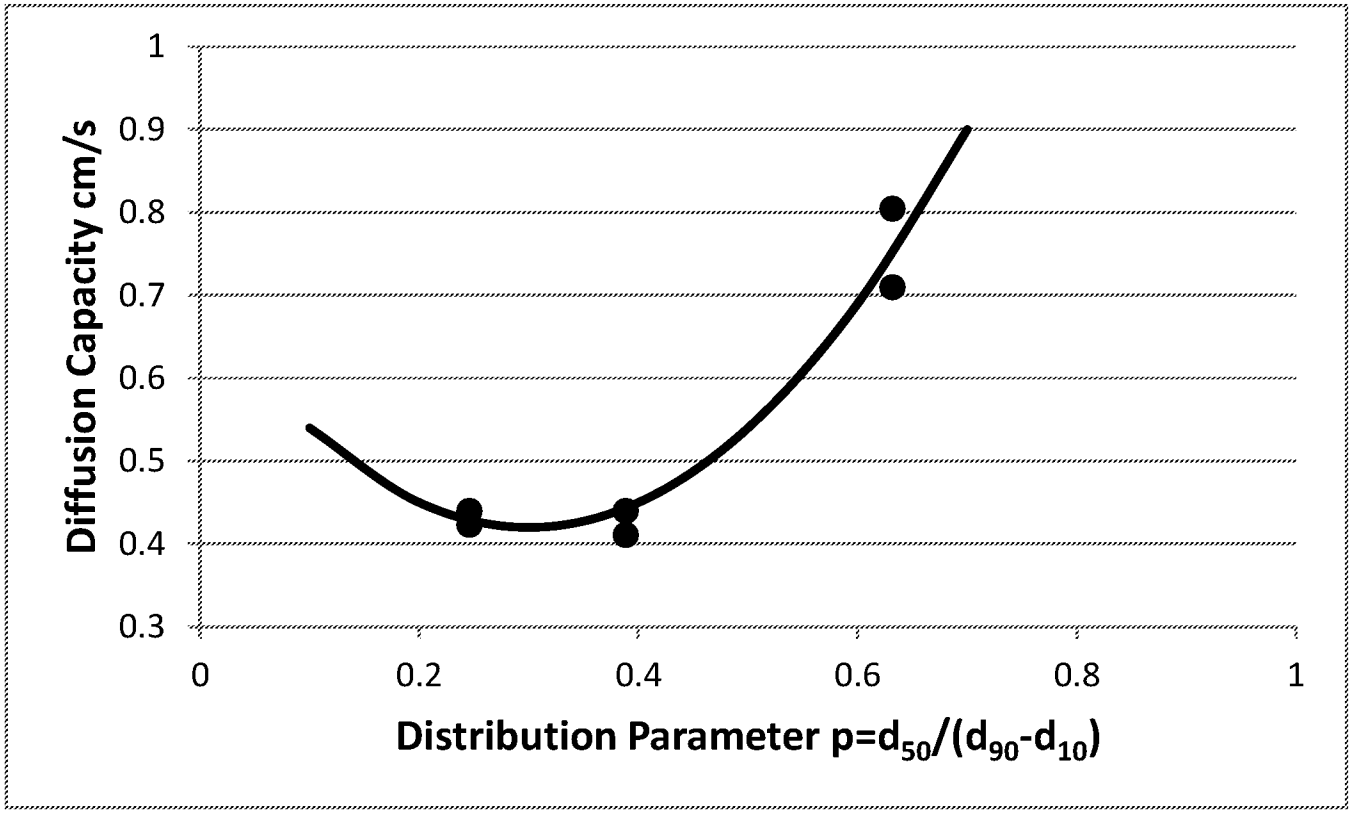
FIG. 2 shows, for rhombohedral fillers, the relationship between the dimensionless distribution parameter p of the particle size distribution and the diffusion capacity.
Figure 3:
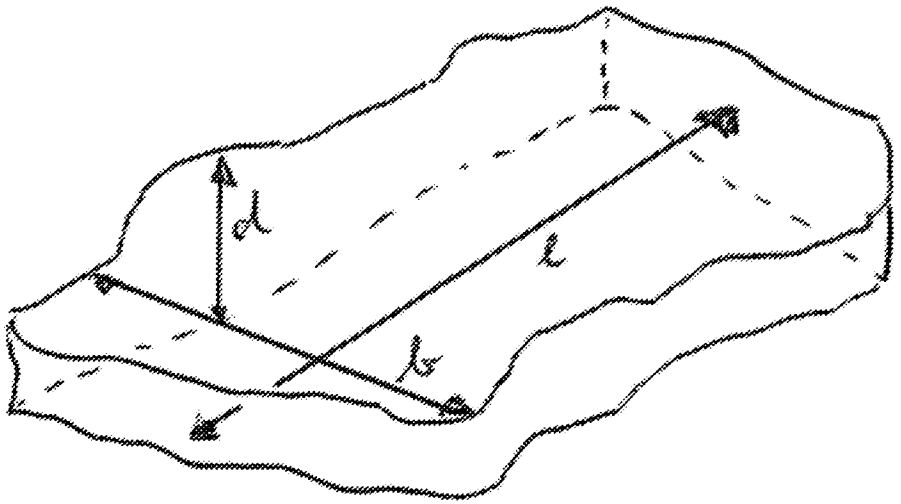
FIG. 3 is a schematic drawing of a flaked calcium carbonate particle, for which the length l, the width b and the thickness d are shown.

In FIG. 2, the values for the distribution parameter p and the diffusion capacities for papers to which a composition with a rhombohedral filler has been applied are shown graphically, that is, for examples 2, 5, 7, 14, 19 and 20. It can clearly be seen that for low values of p, for example, $p<0.5$, a low diffusion capacity can be obtained and thereby a reduction of the diffusion capacity by a factor of more than about 5 compared with the untreated cigarette paper, while for values of $p>0.5$, high diffusion capacities, that is a reduction by a factor of less than about 5, are obtained. The line in FIG. 2 shows the curve $3p\times(p-0.6)+0.7$ in cm/s and illustrates the good correlation of this parameter with the diffusion capacity. The correlation coefficient is greater than 0.98. Whether rhombohedral fillers also exhibit an increase in the diffusion capacity for particularly low values of the distribution parameter p or not cannot be determined reliably from the data. The skilled person is capable of determining this by simple experimentation, however.

The rows in tables 1 and 2 of FIGS. 4 and 5 are ranked in descending order. It can also be seen by comparing the first and second column of FIG. 5 that the order of the chalk types remains approximately the same. Since the examples of tables 1 and 2 of FIGS. 4 and 5 differ only with respect to the cigarette paper, it turns out that the invention can be used essentially independently of the cigarette paper.

In addition, the flow time of the composition, as indicated in table 1 of FIG. 4, should be noted. The flow time is a measure of the viscosity and in all examples is in the relatively narrow interval from 14.3 s to 16.5 s, so that without further adjustments to the process parameters, all compositions can be processed in the same way. Thus, the advantage of a quick adjustment of the diffusion capacity can be employed for small production batches and, depending on the process, without substantial time delay when changing the diffusion capacity.

A particular advantage of the invention, as mentioned above, consists in the fact that the diffusion capacity can be influenced without changing the process parameters or the chemical composition of the composition to be applied, simply by selection of an appropriate crystal structure, shape or size of the filler particles.

The invention can be realized in the following process in a particularly advantageous manner.

Firstly, a cigarette paper is provided to which the composition is to be applied in areas.

In a next step, a preliminary composition is produced, comprising at least the solvent and a material for reducing the diffusion capacity, but at most negligible amounts of the fillers according to the invention. This can preferably be carried out in a receiver tank.

In the case of a starch or a starch derivative, this step can comprise suspending the starch or the starch derivative in water, heating the suspension and maintaining it at an elevated temperature then cooling. All these steps can be carried out while stirring this preliminary composition.

In general, the preliminary composition can be produced according to the instructions of the manufacturer of the material that reduces the diffusion capacity.

The next step consists in selecting the type of filler particle based on the intended diffusion capacity of the treated areas on the cigarette paper.

Here again, the starting point for the following considerations is the diffusion capacity of the areas of a cigarette paper that is treated in areas with a composition that contains, as filler, a geologically sourced chalk with a median particle size of about 2.38 μm. Terms like "high", "higher", "low", "lower" or "middle" in relation to the diffusion capacity should be understood to be with respect to this point of reference.

To obtain a high diffusion capacity, one selects, for example, a flaked calcium carbonate filler. Preferably, the distribution parameter $p=d_{50}/(d_{90}-d_{10})$ should be at least 0.5, preferably at least 0.6 and at most 1.0, preferably at most 0.9.

In order to obtain a low diffusion capacity, a cubic filler is preferably selected. Preferably, the distribution parameter $p=d_{50}/(d_{90}-d_{10})$ should be at least 0.2, preferably at least 0.3 and at most 0.7, preferably at most 0.6.

In order to adjust the diffusion capacity in a median range more precisely, a filler with a scalenohedral crystal structure that leads to the desired diffusion capacity with respect to its distribution parameter $p=d_{50}/(d_{90}-d_{10})$ can preferably be used. For high diffusion capacities in the median range, a filler with a value for p of greater than 0 and less than or equal to 0.3, preferably less than or equal to 0.25 and particularly preferably less than or equal to 0.2 will be selected, or alternatively a filler with a value of $p\geq0.7$, preferably $\geq0.8$, particularly preferably $\geq0.85$ and in particular $\geq0.9$. However, in this regard, p should be $\leq1.2$, preferably $\leq1.0$. For low diffusion capacities in the median range, the distribution parameter p for the scalenohedral filler will be selected so as to be ≥0.3, preferably ≥0.4 and ≤0.7, preferably ≤0.6. To reduce the diffusion capacity, the range 0.45≤p≤0.55 can be used.

Alternatively, in order to adjust the diffusion capacity in the median range, a filler with a rhombohedral crystal structure that leads to the desired diffusion capacity with respect to its distribution parameter $p=d_{50}/(d_{90}-d_{10})$ can also be used. For high diffusion capacities in the median range, a filler with a value of p≥0.5, preferably ≥0.6 and particularly preferably p≥0.7 and preferably less than 1.0, preferably less than 0.8 will be selected. For low diffusion capacities in the median range, the distribution parameter p of the rhombohedral filler will be selected to be ≥0.1, preferably ≥0.2 and ≤0.5, preferably ≤0.4.

With respect to the type of filler, the indications given above are advantageously taken into consideration. Calcium carbonate is preferred and calcite is particularly preferred.

The next step consists in dispersing the filler in the preliminary composition. In this regard, it is essential for the invention that the filler is not added, as is usually the case, to the entire preliminary composition produced in the first step, but only to a part thereof. The amount of filler added to this part of the preliminary composition results from the corresponding desired filler content in the finished composition. This allows for the production of smaller amounts of the finished composition, so that smaller batches of paper can be produced. Furthermore it allows for a quick and trouble-free change of the diffusion capacity by changing the filler, without having to produce the preliminary composition anew.

Dispersing the filler in a part of the preliminary composition can be carried out in various ways.

For example, it is possible to transfer firstly a part of the preliminary composition, for example, by pumping into a further tank and to add the corresponding amount of filler there and to disperse it, for example, by stirring.

Alternatively and preferably, it is also possible to disperse the filler firstly in a solvent, for example, by stirring, wherein preferably, the same solvent is used as for the preliminary composition, and then to add the filler suspension to the preliminary composition while the latter is being transferred to the application apparatus. This is preferred because fillers are often produced or are commercially available as aqueous suspensions ("slurry") and not as dry powder.

The preliminary composition can, for example, be pumped in a pipe from the receiving tank to the application apparatus and the filler suspension is added in the required amount, preferably by pumping, to the same pipe. Particularly preferred thereby is a process in which the flow in the tube is turbulent and thereby mixing of the filler suspension with the preliminary composition occurs as quickly as possible. In a particular advantageous manner, this process can then be used if the dead volume of lines, tanks and devices up to application of the composition to the paper is as small as possible. This can be the case, for example, when application is by means of a spraying process. In this manner, a change of the type of filler can have an effect on the diffusion capacity of the treated areas on the cigarette paper in a very short time, for example, without stopping the application apparatus.

In the following step, the finished composition is transferred to the application apparatus and applied to areas of the paper. The usual processes such as printing processes, in particular roto-gravure printing and flexographic printing, or spraying processes are available for this purpose. Then the paper is dried.

To remove wrinkles that occur when applying aqueous compositions, the aforementioned processes can be used.

In a further embodiment of the process according to the invention, the diffusion capacity of the treated areas can be adjusted further by automatically adapting the mixing ratio of two or more different fillers.

Firstly, the diffusion capacity of the areas of the cigarette paper is measured. This can be carried out by sampling, off-line, on a separate measuring device, for example a Diffusivity Tester (Borgwaldt A50) manufactured by Borgwaldt KC GmbH of Hamburg, Germany, in accordance with CORESTA Recommended Method No. 77, or in the running application apparatus, that is, on-line. Since a direct on-line measurement of diffusion capacity is difficult, it can be estimated from other parameters, for example, transmission, absorption or reflection of electro-magnetic radiation. Such estimation can be carried out with image-analysis tools, for example, based on the transparency of the paper to electromagnetic waves with a wave length of at least 100 nm and at most 500 nm. This can be done by comparing the intensity of a reference beam of these electro-magnetic waves that does not pass through the paper with the intensity of a beam that passes through the paper. The higher the diffusion capacity and hence the pore volume of the paper, the lower will be the attenuation of the beam compared with the reference beam. This comparison of the intensities has to be synchronized with the presence of treated areas in the operational area of the sensor.

The measured value obtained is then compared with a target value and the difference transferred to an actuator that changes the ratio of the amount of fillers added to the preliminary composition. For example, the proportion of cubic calcite will be decreased and the proportion of flaked calcite increased if too low a diffusion capacity is measured and it is desired to increase the diffusion capacity. For a diffusion capacity which is too high, the reverse procedure is followed. This can, for example, be carried out by adjusting the flow rates with a flow controller. Preferably the proportion is adjusted in a manner such that the entire amount of filler in the composition does not change.

Entirely analogously this process can, of course, also be carried out with a mixture of two or more fillers of different shape or crystal structure, for example, cubic and scalenohedral, or flaked and rhombohedral, or cubic, scalenohedral and flaked, or cubic, rhombohedral and flaked.

Finally, in one embodiment of the invention, two scalenohedral fillers can also be used, which differ sufficiently with the distribution parameter $p=d_{50}/(d_{90}-d_{10})$ having regard to the value $p\times(p-1)$. Preferably, a filler with a value of p of greater than 0 and ≤0.3, preferably ≤0.2 will be selected and combined with a filler with a value of p≥0.3, preferably ≥0.4 and ≤0.7, preferably ≤0.6. Alternatively, a filler with a value of p≥0.7, preferably ≥0.8 and ≤1.2, preferably ≤1.0 will be selected and combined with a filler with a value of p≥0.3, preferably ≥0.4 and ≤0.7, preferably ≤0.6.

Similarly, in an embodiment of the invention two rhombohedral fillers can be used that differ sufficiently with respect to the value $p\times(p-0.6)$ with the distribution parameter $p=d_{50}/(d_{90}-d_{10})$. Preferably, a filler with a value of p≥0.1, preferably ≥0.2 and ≤0.5, preferably ≤0.4 will be selected and combined with a filler with a value of p≤0.5, preferably ≥0.6 and ≤1.0, preferably ≤0.8.

For flaked calcium carbonate particles, a filler with a distribution parameter $p=d_{50}/(d_{90}-d_{10})$ from at least 0.5, preferably at least 0.6 to at most 1.0, preferably at most 0.9 can preferably be selected.

For cubic filler particles, a filler with a distribution parameter $p=d_{50}/(d_{90}-d_{10})$ from at least 0.2, preferably at least 0.3, to at most 0.7, preferably at most 0.6 can preferably be selected.

The principle in this respect is that always, independently of shape, crystal structure and particle size distribution, two or more fillers are combined that result in diffusion capacities in the areas on the cigarette paper that are substantially different from each other.

It is also possible to mix two or more fillers of the same shape but different particle size distribution, or even different chemical compounds using this regulation process. However, the mixture of two fillers is preferred because then the regulation process can be designed easily. The use of said mixtures is, of course, also possible without this regulation.

The intervals according to this invention and the preferred intervals for the distribution parameter are generally valid for the use of filler particles with the respective shape or crystal structure irrespectively of whether the filler is used alone or in a mixture of two or more fillers.

From the cigarette papers according to the invention, cigarettes can be manufactured by machine, manually or partially manually by prior art processes.

The invention claimed is:

1. Cigarette paper that has at least one treated area to which a composition that contains filler particles or a mixture of filler particles is applied, wherein the diffusion capacity in the at least one treated area—measured after heating the cigarette paper to 230° C. for 30 min in atmospheric air, subsequent cooling and conditioning in accordance with ISO 187:1990—is smaller by a factor between 2 and 4 than in an untreated area of the cigarette paper and is larger than 0.1 and less than 1 cm/s, wherein at least 50% by weight of the filler particles in the applied composition are formed by calcium carbonate with a flaked shape.

2. Cigarette paper according to claim 1, wherein the calcium carbonate filler particle with flaked shape have a median size $d_{50}$ of at least 0.3 μm, and a median size of at most 5 μm.

3. Cigarette paper according to claim 2, wherein the calcium carbonate with a flaked shape has a median size $d_{50}$ of at least 0.5 μm, and at most 5 μm.

4. Cigarette paper according to claim 1, wherein the following holds for the particle size distribution of the calcium carbonate with a flaked shape: $p \geq 0.5$ and $p \leq 1.0$.

5. Cigarette paper according to claim 1, wherein the calcium carbonate particles with a flaked shape have a length (l), a width (b) and a thickness (d), that correspond to the respective maximum dimensions in three spatial directions mutually orthogonal to each other, wherein the length (1) as well as the width (b) are at least twice as large as the thickness (d).

6. Cigarette paper according to claim 1, wherein the filler is formed by precipitated calcium carbonate.

7. Cigarette paper according to claim 6, wherein said precipitated calcium carbonate is calcite.

8. Cigarette paper according to claim 1, wherein the composition contains a material that is capable of reducing its diffusion capacity upon application to a cigarette paper selected from a group consisting of starch, starch derivatives, cellulose, cellulose derivatives, dextrins, guar or gum Arabic and alginates.

9. Cigarette paper according to claim 1, wherein the amount of material applied in the treated areas, given as mass/applied area in the dried state, is at least 0.5 g/m$^2$ and at most 12 g/m$^2$.

10. Cigarette paper according to claim 1, wherein the at least one treated area is disposed on a wire side of the cigarette paper.

11. Cigarette paper that has at least one treated area to which a composition that contains filler particles or a mixture of filler particles is applied, wherein the diffusion capacity in the at least one treated area—measured after heating the cigarette paper to 230° C. for 30 min in atmospheric air, subsequent cooling and conditioning in accordance with ISO 187:1990—is smaller by a factor between 5 and 8 than in an untreated area of the cigarette paper and is larger than 0.1 cm/s and less than 1 cm/s, wherein at least 50% by weight of the filler particles in the applied composition are formed by a filler with cubic shape.

12. Cigarette paper according to claim 11, wherein the following holds for the particle size distribution of the filler with a cubic shape: $p \geq 0.2$ and $p \leq 0.7$.

13. Cigarette paper according to claim 11, wherein the filler particles with cubic shape are formed by calcium carbonate, titanium dioxide, magnesium oxide, magnesium hydroxide or aluminum hydroxide.

14. Cigarette paper that has at least one treated area to which a composition that contains filler particles or a mixture of filler particles is applied, wherein the diffusion capacity in the at least one treated area—measured after heating the cigarette paper to 230° C. for 30 min in atmospheric air, subsequent cooling and conditioning in accordance with ISO 187:1990—is smaller by a factor between 3 and 6 than in an untreated area of the cigarette paper and is larger than 0.1 cm/s and less than 1 cm/s, wherein at least 50% by weight of the filler particles in the applied composition are formed by a filler with a scalenohedral crystal structure and with a particle size distribution, for which the following holds:

$p \geq 0.8$, or $p \leq 0.3$.

15. Cigarette paper that has at least one treated area to which a composition that contains filler particles or a mixture of filler particles is applied, wherein the diffusion capacity in the at least one treated area—measured after heating the cigarette paper to 230° C. for 30 min in atmospheric air, subsequent cooling and conditioning in accordance with ISO 187:1990—is smaller by a factor of less than 5 than in an untreated area of the cigarette paper and is larger than 0.1 cm/s and less than 1 cm/s, wherein at least 50% by weight of the filler particles in the applied composition are formed by a filler with a rhombohedral crystal structure and with a particle size distribution for which the following holds:

$p \geq 0.6$.

16. Process for producing a cigarette paper with the following steps:

producing a base paper, and treating at least one area of the base paper with a composition that contains filler particles or a mixture of filler particles in order to reduce the diffusion capacity in the treated area compared with the diffusion capacity of the base cigarette paper, by a factor between 2 and 4, to a value that is larger than 0.1 and less than 1 cm/s, wherein the diffusion capacity is measured after heating the cigarette paper to 230° C. for 30 min in atmospheric air and subsequently cooling and conditioning the cigarette paper in accordance with ISO 187:1990, and wherein at least 50% by weight of the filler particles in the composition are formed by calcium carbonate with a flaked shape.

17. Process according to claim 16, wherein the composition contains a material that is capable of reducing the diffusion capacity of cigarette paper upon application to the cigarette paper, the material is selected from the group consisting of starch, starch derivatives, cellulose, cellulose derivatives, dextrins, guar or gum Arabic and alginates.

18. Process according to claim 16, wherein the composition contains a solvent that can form a solution or suspension with a material that is capable of reducing the diffusion capacity upon application to the cigarette paper.

19. Process according to claim 17, with the following steps:

producing a first amount of a preliminary composition that contains a solvent and a material that is capable of reducing the diffusion capacity of the cigarette paper, removing a first part of the preliminary composition, adding the filler particles containing the calcium carbonate with a flaked shape to the removed first part of the preliminary composition in order to form a first composition, and treating areas of the base paper with the first composition.

20. Process according to claim 19, wherein the addition of fillers to the removed part of the preliminary composition is carried out in an application apparatus or in a pipe feeding to the application apparatus for the application of the preliminary or first composition, respectively.

21. Process according to claim 16, wherein the composition is applied by a printing process, wherein the composition preferably has a flow time of at least 10 s and at most 35 s, measured with a flow cup with a 4 mm opening in accordance with EN ISO 2431:2001 at a temperature of the composition of 60° C., or is applied by a spraying process.

22. Process according to claim 16, wherein the cigarette paper is re-wetted after the application of the composition and subsequently dried under mechanical load in order to avoid wrinkles in the cigarette paper, wherein the composition preferably contains substances to reduce the formation of wrinkles, in particular propylene glycol or glycerin.

23. Cigarette with a cigarette paper that wraps a tobacco column, wherein the cigarette paper is a cigarette paper according to claim 1.

24. Cigarette according to claim 23, wherein the filler, respectively, in the composition is selected such that the cigarette extinguishes with a probability of at least 75% in a test in accordance with ISO 12863:2010, but during smoldering in air smolders over the entire length of its tobacco column with a probability of at least 50% without self-extinguishing.

* * * * *